United States Patent [19]

Yount

[11] 4,035,218

[45] July 12, 1977

[54] LAMINATING METHOD FOR PRODUCING PRESSURE-SENSITIVE ADHESIVE COATED SUBSTRATES HAVING A RELEASE LAYER AFFIXED THERETO

[75] Inventor: Roger E. Yount, Troy, Ohio

[73] Assignee: The Brown-Bridge Mills, Inc., Troy, Ohio

[21] Appl. No.: 667,188

[22] Filed: Mar. 15, 1976

[51] Int. Cl.[2] ..... C09J 7/04

[52] U.S. Cl. ..... 156/289; 156/310; 156/324; 156/332; 156/334; 427/207 B; 427/207 D; 427/391; 427/411

[58] Field of Search ..... 156/247, 289, 309, 324, 156/332, 310, 334; 427/207 B, 207 D, 391, 411; 428/40, 354

[56] References Cited

U.S. PATENT DOCUMENTS

| | | | |
|---|---|---|---|
| 2,453,258 | 11/1948 | Pearson | 427/207 B |
| 3,515,630 | 6/1970 | Columbus et al. | 156/332 |
| 3,532,652 | 10/1970 | Zang et al. | 428/40 |
| 3,767,500 | 10/1973 | Tally et al. | 156/309 |
| 3,914,484 | 10/1975 | Creegan et al. | 427/207 B |
| 3,922,464 | 11/1975 | Silver et al. | 427/207 B |
| 3,962,012 | 6/1976 | Schumacher | 156/324 |

*Primary Examiner*—William A. Powell
*Assistant Examiner*—Basil J. Lewris
*Attorney, Agent, or Firm*—Biebel, French & Nauman

[57] ABSTRACT

A method for producing releasable laminates by coating a water-dispersed pressure-sensitive adhesive onto either a web of paper face stock or a web of release paper, joining the two webs together with the adhesive therebetween while the adhesive is still wet, and then drying under moderate conditions to produce a relatively wrinkle-free and flat laminate having an exceptionally smooth and uniform adhesive layer.

9 Claims, 1 Drawing Figure

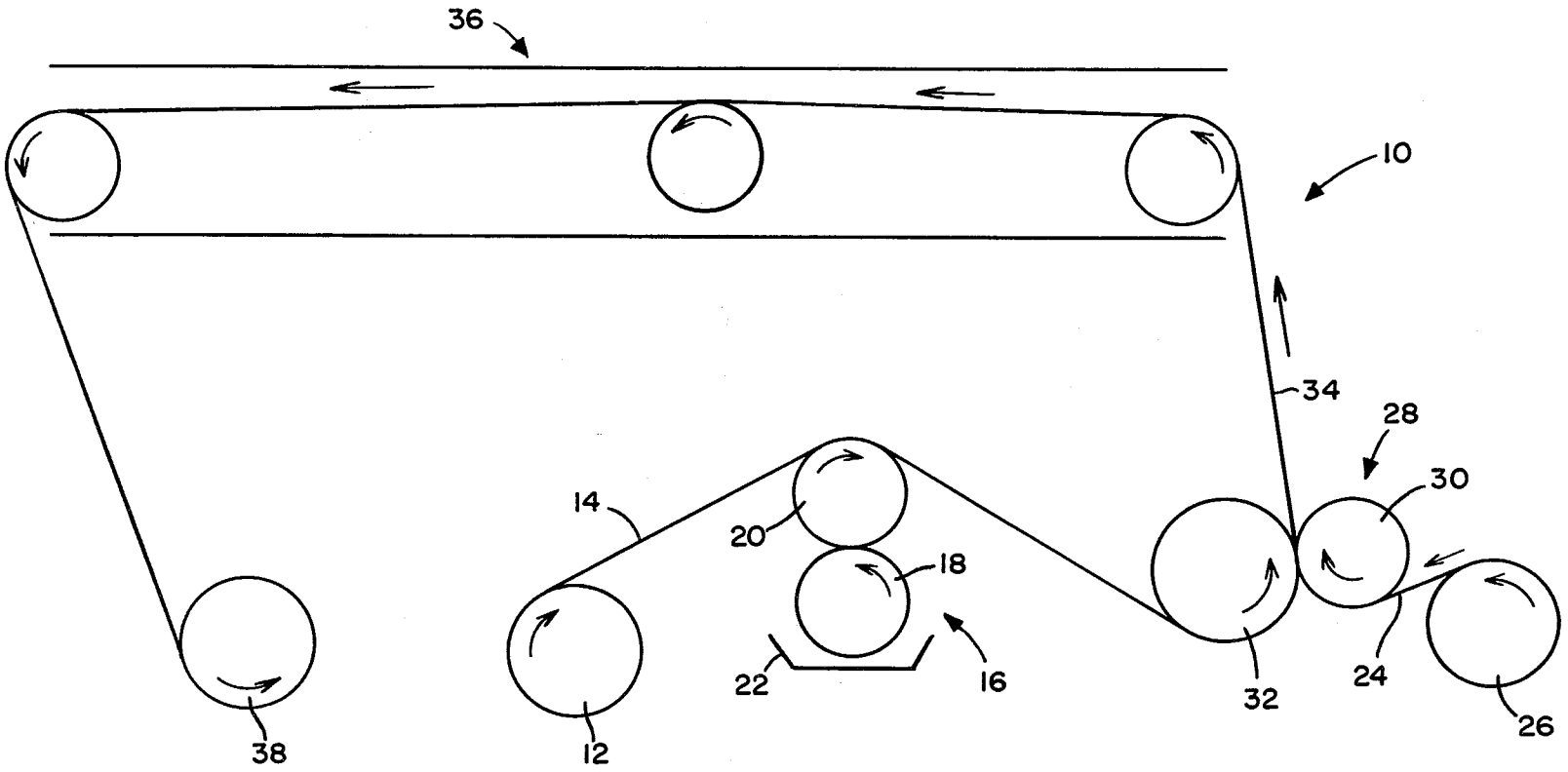
10
12
14
16
18
20
22
24
26
28
30
32
34
36
38

LAMINATING METHOD FOR PRODUCING PRESSURE-SENSITIVE ADHESIVE COATED SUBSTRATES HAVING A RELEASE LAYER AFFIXED THERETO

BACKGROUND OF THE INVENTION

This invention relates to a process for preparing pressure-sensitive adhesive coated substrates having a release layer releasably affixed thereto and, more particularly, to a new method of laminating a continuous web of release paper to a web of paper face stock coated with a water-dispersed pressure-sensitive adhesive.

At present water-dispersed pressure-sensitive adhesive composites (paper face stock, adhesive, release paper) are prepared by (a) applying the water-dispersed pressure-sensitive adhesive to a continuous web of paper face stock, (b) drying the coated web in a drier to remove the water, (c) releasably laminating a continuous web of coated release paper to the dried, adhesive-coated web in the nip of pressure rollers, and (d) winding the resultant laminate on a rewind roll for further processing. The reverse of this is also practiced whereby the water-dispersed pressure-sensitive adhesive is coated to the release paper, the coating dried and then the coated release liner laminated to the face stock and the resultant laminate wound on a rewind roll for further processing.

That further processing generally involves sheeting, slitting or other converting. After that, the laminate is typically printed, cut and collated by a printer to form individual printed sheets. Such sheets may be utilized for any number of uses including name tags, stickers, labels, etc., by simply peeling away the release liner and pressing the adhesive coated side of the face sheet to the desired substrate.

Problems are encountered with both of these methods, however, in the form of wrinkles or curl primarily due to the instability of the resultant laminate because one of the laminae just prior to assembly has lost some of its normal moisture having been exposed to heat in the drier while the other laminae which was not dried has its normal moisture content. This resultant unstable laminate, when exposed to atmospheric conditions relieves the stresses imparted to it by curling or developing wrinkles wherein the release paper detaches itself from the adhesive.

A laminate exhibiting curl or wrinkles is almost impossible to print or further convert and is therefore of little value. One method of overcoming the defects just described is to subject the member of the laminate emerging from the drier to a process which reintroduces sufficient moisture to it to produce a laminate which is stable when exposed to atmospheric conditions. This may be accomplished by spraying moisture on the dried web or putting it through a humidity conditioning section. However, it is somewhat difficult to reintroduce the exact moisture content into the dried web to permit it to be in equilibrium moisture content with the other member of the laminate.

SUMMARY OF THE INVENTION

The present invention eliminates these problems by utilizing a process involving in situ removal of water from the water-dispersed adhesive after the lamination has been made. Thus, in the present method the web of paper face stock is joined to a web of moisture-sensitive or absorptive release paper with a water-dispersed pressure-sensitive adhesive therebetween while the adhesive is still wet and, then, the laminate passed through a heated drier tunnel to dry the water-dispersed pressure-sensitive adhesive to the appropriate moisture level.

While it has been known to form a porous substrate, adhesive, non-porous substrate composite by joining the lamina and then driving solvent vapors off through the porous substrate, as far as known this has been only in the context of forming a permanently bonded laminate (see U.S. Pat. No. 3,756,892 to Mills, U.S. Pat. No. 2,652,351 to Gerhardt and U.S. Pat. No. 2,453,258 to Pearson). It is somewhat surprising that the same concept can be used in forming a releasable laminate of a pressure-sensitive adhesive coated substrate and release layer in contact with the adhesive. More surprising are the advantages achieved in doing so.

Among these advantages is the fact that the pressure-sensitive adhesive layer in the resultant laminate is uniform even though applied by a coating method which very often yields a patterned coating such as roll coating. Specifically, it has been found that the coated surface of the release paper acts as a cast coater, smoothing the still wet water-dispersed pressure-sensitive adhesive upon lamination. The smooth, uniform thickness pressure-sensitive adhesive layer produces labels having better adherence properties.

Likewise, by joining the laminae when the adhesive is still wet, the moisture level in the whole laminate equilibrates evenly throughout. This moisture equilibration takes place both in the drying operation and in the conditioning period which rolled-up laminate undergoes prior to unwinding for further processing. On exit from the drier the laminate should have a 30–60% relative humidity (Cambridge Moisture Indicator test).

It is believed that wrinkling and curl defects mentioned may be attributable to differences in the web tension and/or ultimate moisture content of the paper face stock and release paper. Therefore, by subjecting the joined laminae to the same tension and drying conditions, as is done in the present invention, these differences are minimized and the defects reduced. The result is a relatively wrinkle-free, and flat laminate.

Accordingly, it is an object of the present invention to provide a method of laminating a continuous web of moisture sensitive or absorptive release paper to a web of paper face stock with a water-dispersed pressure-sensitive adhesive therebetween and then drying the joined laminae.

Other objects and advantages of the present invention will be apparent from the following description, the accompanying drawing and the appended claims.

BRIEF DESCRIPTION OF THE DRAWING

The FIGURE is a schematic illustrating the preferred process of the present invention.

DETAILED DESCRIPTION OF THE PREFERRED EMBODIMENT

Referring to the FIGURE, there is schematically shown a lay-out 10 for performing the process of the instant invention. Roll 12 is a supply roll of paper face stock. This paper face stock may include, but is not necessarily restricted to, fluorescent paper (ranging from 45 lbs/ream (3300 sq. ft.) to tag weight — 125 lbs), kraft paper (from 35–90 lbs/3000 sq. ft. ream), English finish (45–60 lbs/3300 sq. ft.), coated one or two side litho (50–100 lbs/3300 sq. ft.), cast coated face stock 55 to 120 lbs/3300 sq. ft.), or offset papers, highly calendered papers, etc.

Upon being unwound from roll 12, web 14 of the paper face stock is advanced to coating station 16 which may be any of the known types of coaters suitable to apply a fluid coating to paper in the thickness range of 1 to 10 mils wet. Shown in the FIGURE as illustrative is a two roll kiss coater having a pick-up roll 18, an applicator roll 20, and a pan 22 to supply the water-dispersed pressure-sensitive adhesive. A doctor blade and a subsequent metering station such as a wire-wound rod, not shown, may be used with the coater.

As shown in the FIGURE, the water-dispersed pressure-sensitive adhesive is coated onto web 14 at station 16. Preferably the adhesive used is a water-dispersed acrylic-ester-vinyl acetate copolymer having around a 50% solids content. Other water-dispersed pressure-sensitive adhesives which may be used with the present process include ethylene-vinyl acetate copolymers, suitably plasticized vinyl acetate homopolymers, rubber latex-resin emulsion systems, and acrylic copolymers which are composed of the various acrylate ester monomers known to produce pressure-sensitive adhesives. The solids content of the adhesives may vary from about 35 to 65%. The viscosity of the adhesives may be adjusted by thinning with water or using compatible thickeners to give the optimum flow properties for smooth, uniform coatings.

The release paper is typically selected from a number of known and available papers having a release material coated onto one side of the paper web. The base paper of the release liner may be selected from krafts, super-calendered krafts, clay coated krafts, glassines, parchments, and other papers which have a suitable undercoating for release coating hold-out. The release coating may be any of the known materials used for their release properties for pressure-sensitive adhesives. Preferred types are silicones and modified silicones, the modification including both copolymerization of silicones with other non-release chemical agents or by adding non-silicone materials to the silicone coating solution prior to application to the release base paper. Other release agents such as polyethylene, fluorocarbon, the Werner type chromium complexes and polyvinyl octadecyl carbamate may also be used. The choice of the release coating is dependent on the tack and adhesion level of the adhesive.

The only requirement of the release paper is that it be sensitive and/or absorptive to moisture so that it may equilibrate with the face stock. Thus, a release paper with a moisture-impervious coating on the non-release surface, e.g., polyethylene, would not be suitable since it would not permit equilibration with the face stock.

The adhesive is generally applied to give a resultant coat weight of between 10 and 22 lbs/ream (3300 sq. ft.). As an example, when producing label stock a coat weight of 15–16 lbs/ream (3300 sq. ft.) is preferred. On the other hand, when producing name tags a coat weight of 20–22 lbs/ream (3300 sq. ft.) is preferred.

Alternative to coating the adhesive onto the paper face stock, it may be coated onto the release paper. In this instance, the release paper would be designated as roll 12 and the proper face stock would be roll 26. In either event, webs 14 and 24 are brought together with the adhesive therebetween at laminating station 28, comprising pressure roll 30 and laminating drum 32.

The laminate 34 is led from laminating station 28 to tunnel drier 36 which provides gradient drying, for example, by means of two drying zones. The first zone is merely an unheated air dry (ambient temperature). Likewise, laminating drum 32 is preferably not heated in the instant process. Thus, laminate 34 on entering tunnel drier 36 has not faced high enough temperatures for any substantial drying. Within the second zone of tunnel drier 36 moderately low temperatures are maintained, i.e., ranging from approximately 120°–180°F. Similarly, the speed through tunnel drier 36 is relatively slow — on the order of 100–300 feet per minute, and preferably 100–150 feet per minute.

This drying step allows for the various laminae to reach a moisture equilibrium as low temperatures are used, and relatively long dwell times are envisioned. Thus it is theorized that as drying occurs at least a major portion of the water from the adhesive has migrated into the face sheet. A minor portion may migrate into the release paper. On exit from tunnel drier 36, then, the laminate should have a Cambridge Moisture Indicator reading of around 30–60% relative humidity and preferably 40–50%.

Additional moisture equilibration takes place on aging the rolled laminate. Laminate 34 in the FIGURE is shown being wound on rewind roll 38. On the roll 38, it may be allowed to condition at room temperature and pressure for a period of time ranging from about 1 to 10 days before being subjected to further processing.

Upon equilibration a releasable laminate of highly desirable properties is produced. During lamination the still-wet adhesive coating has been smoothed against the coated surface of the release paper and the composite laminate allowed to reach a moisture equilibrium in the drying stage. These desirable features were found to exist in the laminates produced in accordance with this invention as illustrated by the following example.

EXAMPLE

Using a layout as shown in the Figure, a 60 lb/ream (3300 sq. ft.) white cast coated face stock (Kromekote from Champion International of Middletown, Ohio) was coated on the non-cast coated side with a water-dispersed pressure-sensitive adhesive (a 50% solids acrylic ester-vinyl acetate copolymer modified with a small amount of antifoaming agent). The applied coat weight was approximately 15 lb/ream (3300 sq. ft.). To this was joined a 50 lb/ream (3000 sq. ft.) release paper (KC-50 from Fitchburg CPI, Scranton, Pa.) in the nip of a non-heated laminating drum and pressure roller at sufficient pressure to marry the two lamina. The laminate was then passed through a tunnel drier with an ambient temperature air flow in the first zone and heating at 120° F in the second zone. The speed of the laminate through the drier was 110 feet per minute. It was then wound on a rewind roll.

After conditioning for one week, the laminate was given the normal finishing process with completely satisfactory results. The laminate was well equilibrated as evidenced by being completely flat, free of wrinkles and could be score-cut satisfactorily without disturbing the release paper from the adhesive layer.

While the method herein described constitutes a preferred embodiment of the invention, it is to be understood that the invention is not limited to this precise method, and that changes may be made therein without departing from the scope of the invention which is defined in the appended claims.

What is claimed is:

1. A method for producing releasable laminates having a paper substrate coated with a tacky pressure-sensitive adhesive and a release layer releasably affixed to the pressure-sensitive adhesive comprising:

a. providing a web of paper face stock,
b. providing a web of moisture sensitive or absorptive release paper having a release material coated thereon,
c. coating either said web of paper face stock or the previously coated side of said web of release paper with a water-dispersed pressure-sensitive adhesive,
d. before drying, joining the webs together with the still-wet adhesive therebetween,
e. passing the joined webs through a pressure nip to form a laminate, then
f. drying said laminate to a relative humidity of around 30–60% (Cambridge Moisture Indicator test) so as to allow for a moisture equilibration between said webs,
g. winding said laminate on a roll, and
h. conditioning said laminate for a period of time prior to further processing to allow for additional moisture equilibration between said webs, whereby there is produced a laminate having a pressure-sensitive adhesive coated substrate and a release layer thereover, said adhesive being smooth and uniform and said laminate being relatively wrinkle-free and flat.

2. The method of claim 1 wherein said drying step takes place in a drier providing gradient drying, and the speed of throughput for the laminate being relatively slow so as to produce around 30–60% relative humidity (Cambridge Moisture Indicator test) on exit from said drier.

3. The method of claim 2 wherein said temperature is in a gradient from ambient to 120°–180° F and said speed is 100–300 feet per minute.

4. The method of claim 3 wherein said conditioning step is aging for approximately 1 to 10 days at room temperature and pressure prior to further processing.

5. The method of claim 1 wherein said paper face stock is selected from the group consisting of fluorescent paper, kraft paper, English finish paper, coated one or two side litho, cast coated face stock, offset paper and highly calendered paper, and said adhesive is selected from the group consisting of acrylic ester-vinyl acetate copolymers, ethylene-vinyl acetate copolymers, plasticized vinyl acetate homopolymers, rubber latex-resin emulsions, and acrylic ester homopolymers and copolymers.

6. The method of claim 5 wherein said adhesive is a water-dispersed acrylic ester-vinyl acetate copolymer having approximately a 35–65% solids.

7. The method of claim 6 wherein said adhesive is coated onto said paper face stock within a coat weight range of about 10–22 lbs/ream (3300 sq. ft.).

8. The method of claim 7 wherein said laminate is dried by gradient drying ranging in temperature from ambient to 120°–180° F, said laminate is passed through said drier at the rate of 100–300 feet per minute, and said laminate exits from said drier at a 40–50% relative humidity (Cambridge Moisture Indicator test).

9. The method of claim 8 wherein said laminate is conditioned in roll form about 1 to 10 days prior to further processing.

* * * * *